United States Patent [19]

Konno

[11] 3,955,232

[45] May 11, 1976

[54] COKE OVEN CLEANER

[75] Inventor: Nagayoshi Konno, Tokyo, Japan

[73] Assignee: Koritsu Kikaikogyo Co., Limited, Japan

[22] Filed: June 6, 1974

[21] Appl. No.: 476,904

[52] U.S. Cl. ..... 15/93 A; 202/241

[51] Int. Cl.[2] ..... C10B 43/04

[58] Field of Search ..... 214/18 R, 23; 15/93 A; 202/241

[56] References Cited

UNITED STATES PATENTS

| | | | |
|---|---|---|---|
| 1,759,015 | 5/1930 | McIntosh | 15/93 A |
| 3,758,910 | 9/1973 | Lakeberg | 202/241 X |

*Primary Examiner*—Robert G. Sheridan
*Attorney, Agent, or Firm*—McGlew and Tuttle

[57] ABSTRACT

The coke oven cleaner is capable of scraping particularly the entrance areas of a coke oven automatically to remove tar and the like adhered thereon completely, and comprises an upright stationary holding or support frame mounted on a door lifter, and a first scrapers-holding frame movable up and down the stationary holding frame and carrying first scrapers arranged to engage the door sealing surface of the coke oven entrance. A second scrapers-holding frame is movable with the first scrapers-holding frame and carries second scrapers engageable with the interior surfaces of the door frame and with the brick lining of the coke oven. Heat-blocking plates are movable with the first and second scrapers-holding frames. The second scrapers-holding frame comprises a pair of interdependent substantially parallel upright members interconnected by linkages, similar to toggle linkages, for movement laterally toward and away from each other by a hydraulic actuator or the like acting on one of the linkages.

7 Claims, 5 Drawing Figures

COKE OVEN CLEANER

FIELD AND BACKGROUND OF THE INVENTION

This invention relates to an improved cleaner for coke ovens, more particularly for the entrance areas of the coke oven chamber. The conventional horizontal chamber type coke oven is equipped with a door at both sides, pusher side and quencher side. The door and the entrance areas of the coke oven, to which much tar and the like ad here when the coal is baked to coke, must be cleaned for the next coking operation.

The object of the invention is to provide a new and useful coke oven cleaner which is capable of scraping particularly the entrance areas of the coke oven automatically to remove tar and the like completely. The door is disclosed in application Ser. No. 283,922, filed Aug. 25, 1972 and now U.S. Pat. No. 3,822,191 issued July 2, 1974.

SUMMARY OF THE INVENTION

The coke oven cleaner of this invention characteristically comprises 1) a stationary holding means, 2) a first scrapers-holding means movable up and down along the stationary holding means by the action of a driving means, 3) a second scrapers-holding means movable together with the first scrapers-holding means, 4) a heat-blocking means movable together with the first and second scrapers-holding means, the second scrapers-holding means consisting of a pair of interdependent members movable toward and away from each other by the action of a regulator means acting through a plurality of hinge means.

For an understanding of the principles of the invention, reference is made to the following description of the typical embodiment thereof as illustrated in the accompanying drawings.

DESCRIPTION OF THE PREFERRED EMBODIMENT

Figure 2:
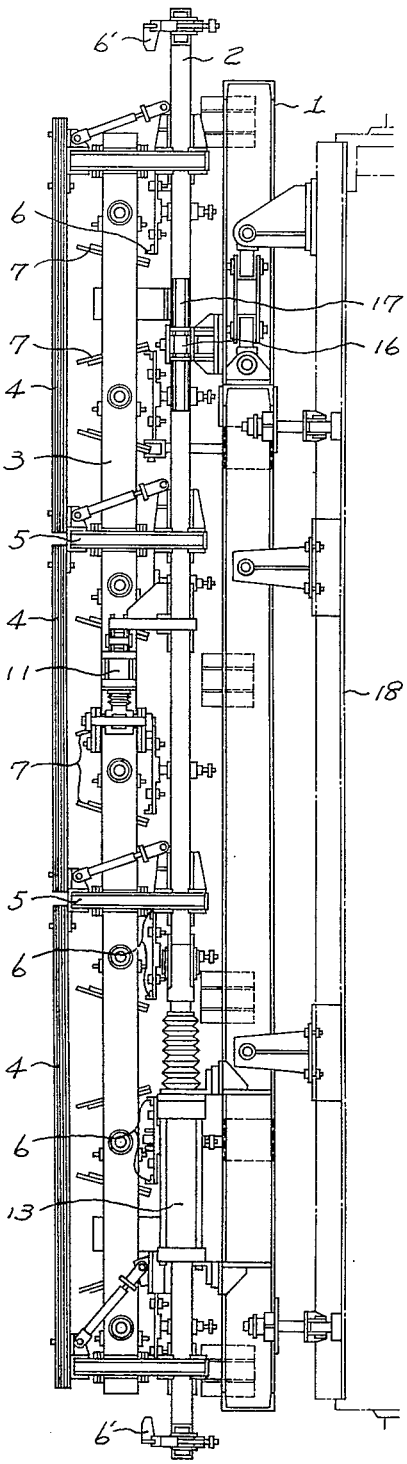
FIG. 2 is a side elevation view, partly in section, of the coke oven cleaner as mounted on the back of a door lifter.
Figure 1:
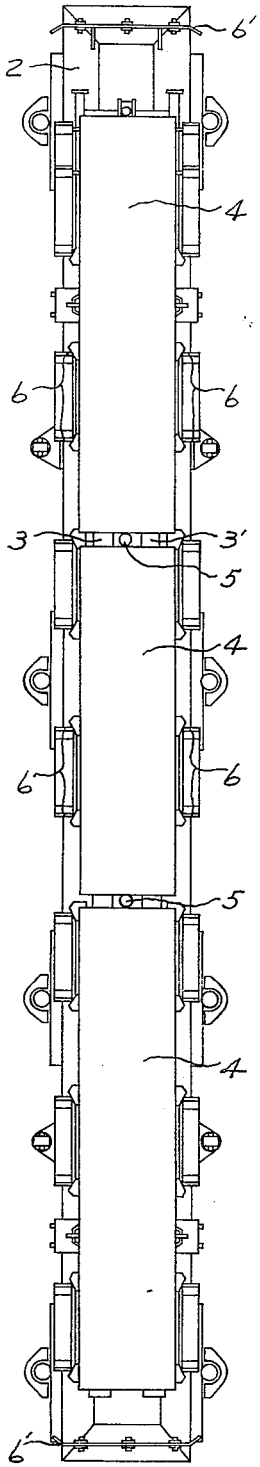
FIG. 1 is a front elevation view of a coke oven cleaner embodying the invention.
Figure 3:
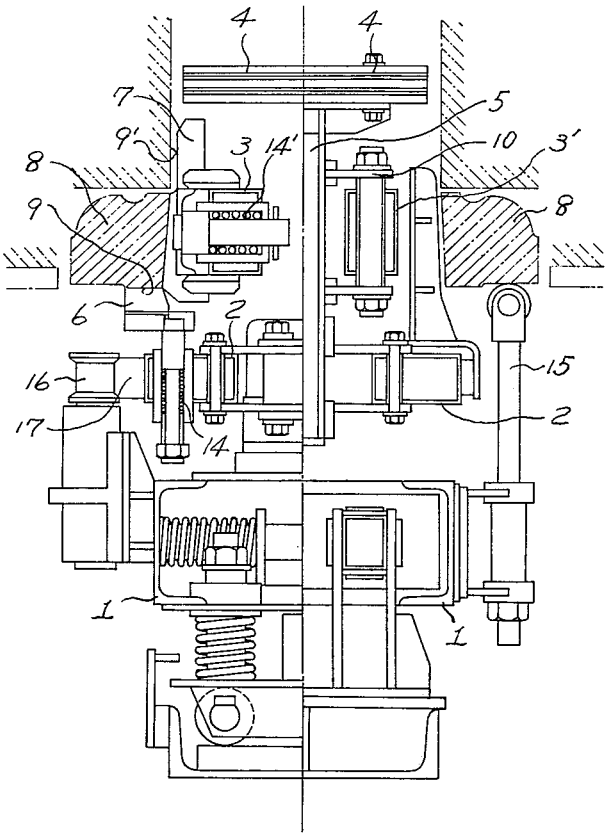
FIG. 3 is a plan view, partly in section, of the coke oven cleaner.
Figure 4:
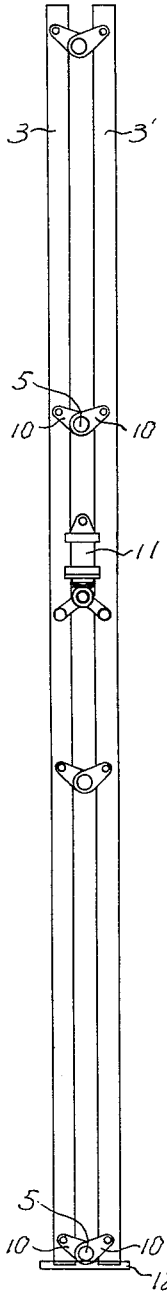
FIG. 4 is an explanatory elevation view of the interdependent frame members shifted toward each other by the action of a hydraulic cylinder.
Figure 5:
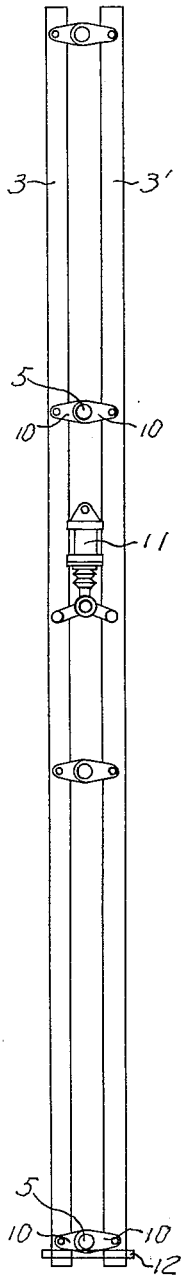
FIG. 5 is a view similar to FIG. 4 illustrating the frame members shifted away from ach other by the action of the hydraulic cylinder.

Referring to FIGS. 1, 2, 3, the apparatus comprises a center frame 2, as a first scrapers-holding means, movable up and down along a stationary frame 1. The center frame 2 is provided, through shafts 5, extending laterally thereof, with a pair of interdependent frames 3, 3,' as a second scrapers-holding means and with plural heat-blocking plates 4. Both sides and the upper and lower ends of the center frame 2 are provided with a plurality of blades 6, 6' serving as scrapes for cleaning the door sealing surface 9. The interdependent frames 3, 3' are, as shown in FIGS. 4 and 5, operatively associated for shifting toward and away from each other by links 10 which are hinged to shaft 5. On the outside of the interdependent frames 3, 3' there are mounted as shown in FIGS. 2 and 3, a plurality of blades 7 serving as scrapers for cleaning the inner surface of the coke oven chamber. Further, the interdependent frames 3, 3' are guided at one end thereof by a stopper 12 provided to fully shift the frames. This stopper 12 serves not only correctly toregulate the movement of the interdependent frames 3, 3' but also to effect a good contact of the scrapers 7 with to the inner surface of the coke oven entrance area.

For actuating the links 10 to shift the interdependent frames 3, 3' toward and away from each other, there is provided, as shown in FIGS. 2 4 and 5, a hydraulic cylinder 11, as a regulator means, on the center portion of the center frame 2. For moving the center frame 2, the interdependent frames 3, 3' and the heat-blocking plates 4 together up and down, a hydraulic cylinder 13, serving as a driving means, is mounted on the lower portion of the stationary frame 1 as shown in FIG. 2. The scrapers 6,6', 7, are pressed by the springs 14, 14' toward the respective faces 9, 9' as shown in FIG. 3. To secure the smooth up-and-down movements of the center frame 2, the interdependent frames 3, 3' and the heat-blocking plates 4, there are provided, as shown in FIG. 3, guide rolls 16 extending laterally from both sides of the stationary frame 1, which guide rolls engage guide rails 17 extending laterally from both sides of the center frame 2. The present coke oven cleaner is installed, as shown in FIG. 2, on the back of the door lifter 18. But, it may be installed on the side of the door lifter or on any other installing or mounting means.

In carrying out the cleaning operation, the cleaner of this invention is brought to the front of the entrance of the coke oven chamber and then the hydraulic cylinder 11 is actuated to shift the interdependent frames 3, 3' inwardly as shown in FIG. 4. The links 10 consequently assume V-shaped around the pivot shafts 5, thus resulting in the inward or retracting movement of the interdependent frames 3, 3'. As a consequence, the scrapers 7, mounted on the frames 3, 3' are retracted, this allowing easy entrance of the cleaner into the coke oven chamber until a stopper 15, which is provided on the side of the stationary frame 1, reaches the limit as shown in FIG. 3. Meanwhile, the scrapers 6, 6' on the center frame 2 are pressed onto the door sealing surface 9. Then, the hydraulic cylinder 11 is actuated in the opposite direction to straighten the links 10, thus forcing the interdependent frames 3, 3' outwardly. Consequently, the scrapers 7 are pressed onto the inner surface of the door frame 8 and the oven brick surface 9'.

After the above operation, the main cylinder 13 is actuated to move the center frame 2, the interdependent frames 3, 3' and the heat-blocking plates 4 together up and down. The scrapers 6, 6', are thus moved up and down while scraping the door sealing surface and the inner surface of the entrance areas of the coke oven to remove tar and the like adhered thereon completely. For drawing out the cleaner from the entrance areas of the coke oven, the interdependent frames 3, 3' are retracted toward each other by the action of the hydraulic cylinder 11 to disengage the scrapers 7 from the contacting surfaces so that the cleaner can be easily drawn out from the entrance without either the cleaner or the entrance surfaces being damaged.

Since the present cleaner is constructed as above, the wide range of tars adhered surfaces, which includes not only the inner surface of the door frame 8 but also the inner surface 9' of the oven brick, can be completely cleaned. The employment of the heat-blocking plates 4 serves to prevent the cleaner from being otherwise damaged by heat in the coke oven. Further, since the scrapers 6, 6', are pressed onto the cleaning surfaces by springs 14, 14' with moderate pressure, there can be expected that, on one hand, no excessive force acts on the cleaning surface which otherwise may result in damages thereon, while, on the other hand, all of the scrapers securely work on the cleaning surface without becoming loose.

It is to be noted that, though the blade type scrapers are employed for cleaning the door surface and the entrance areas of the coke oven, other scraper means may also be employed instead, for example radial cutter type scrapers, cylindrical scrapers and the like.

What is claimed is:

1. A coke oven cleaner, for cleaning the entrance of a coke oven chamber having a door frame with a door sealing surface, said cleaner comprising, in combination, an upright stationary holding means; a first scrapers-holding means reciprocable along said upright stationary holding means and carrying scrapers engageable with said door sealing surface; driving means operable to reciprocate said first scrapers-holding means; a second scrapers-holding means mounted on said first scrapers-holding means for movement therewith, and carrying scrapers engageable with the interior surface of said door frame and with the interior surface of said coke oven chamber; heat-blocking means movable together with said first and second scrapers-holding means, said heat-blocking means, in the operative position of said coke oven cleaner, being interposed between the interior of the coke oven and said first and second scrapers-holding means; said second scrapers-holding means comprising a pair of interdependent upright members interconnected by a plurality of pivotal linkages for movement toward and away from each other; and regulator means mounted on said first scrapers-holding means and operatively associated with said pivotal linkage to move said interdependent members toward and away from each other whereby said interdependent members may be retracted toward each other for insertion of said second scrapers-holding means into door frame and then moved away from each other to engage the scrapers carried thereby with the interior surfaces of said door frame and of said coke oven chamber entrance.

2. A coke oven cleaner in accordance with claim 1 wherein said first and second scrapers-holding means are equipped with blade type scrapers.

3. A coke oven cleaner in accordance with claim 1 wherein said driving means and said regulator means are hydraulic cylinders.

4. A coke oven cleaner in accordance with claim 1, including at least one guide roller mounted on said stationary holding means to extend laterally therefrom; respective guide rails on said first scrapers-holding means engageable with said guide rollers; and stoppers mounted on said stationary holding means and engageable with said door frame to limit movement of said coke oven cleaner into said coke oven chamber entrance.

5. A coke oven cleaner in accordance with claim 1, including springs biasing said scrapers into engagement with the respective surfaces to be cleaned.

6. A coke oven cleaner in accordance with claim 1, including shafts supported on and extending laterally of said first scrapers-holding means; said pivotal linkages comprising respective pairs of links having inner ends pivoted on said shafts and outer ends pivotally connected to said interdependent members, to act in the nature of toggle linkages; said regulator means forcing said links into U-shaped configurations to retract said interdependent members toward each other and scraping said links to move said interdependent members away from each other.

7. A coke oven cleaner in accordance with claim 6, including guide means engageable with at least first ends of said interdependent members.

* * * * *